US005112278A

United States Patent [19]

Roberts

[11] Patent Number: 5,112,278

[45] Date of Patent: May 12, 1992

[54] EXTRUDED PLASTIC ROOF RIDGE VENTILATOR

[75] Inventor: Edward A. Roberts, Mount Clemens, Mich.

[73] Assignee: Color Custom, Inc., Warren, Mich.

[21] Appl. No.: 580,640

[22] Filed: Sep. 11, 1990

[51] Int. Cl.[5] ..... F24F 7/02

[52] U.S. Cl. ..... 98/365; 98/42.2

[58] Field of Search ..... 98/42.21, 42.16, 42.2

[56] References Cited

U.S. PATENT DOCUMENTS

| | | | |
|---|---|---|---|
| 3,862,529 | 1/1975 | Markos | 52/199 |
| 4,045,928 | 9/1977 | Malott | 52/199 |
| 4,080,083 | 3/1978 | Malott | 403/305 |
| 4,280,399 | 7/1981 | Cunning | 98/42.21 |
| 4,545,292 | 10/1985 | Inokawa et al. | 98/42.21 |
| 4,558,637 | 12/1985 | Mason | 98/42.21 |
| 4,643,080 | 2/1987 | Trostle et al. | 98/42.21 |
| 4,676,147 | 6/1987 | Mankowski | 98/42.21 |
| 4,803,813 | 2/1989 | Fiterman | 52/199 |
| 4,817,506 | 4/1989 | Cashman | 98/42.21 |
| 4,876,950 | 10/1989 | Rudeen | 98/42.21 |
| 4,903,445 | 2/1990 | Mankowski | 98/42.21 X |
| 4,957,037 | 9/1990 | Tubbesing et al. | 98/42.21 |

FOREIGN PATENT DOCUMENTS

| | | | |
|---|---|---|---|
| 3615015 | 12/1987 | Fed. Rep. of Germany | 98/42.21 |

*Primary Examiner*—Albert J. Makay
*Assistant Examiner*—William C. Doerrier
*Attorney, Agent, or Firm*—Brooks & Kushman

[57] ABSTRACT

A roof ridge ventilator (10) is disclosed which includes an elongated extruded plastic ridge cover (12) and a pair of elongated extruded plastic vents (14) connected to the ridge cover (12). The ventilator (10) may be extruded in one piece or, alternatively, a pair of vent members (50) may be separately extruded and then attached to the ridge cover (10).

11 Claims, 2 Drawing Sheets

EXTRUDED PLASTIC ROOF RIDGE VENTILATOR

TECHNICAL FIELD

This invention relates to ventilators for roof ridges.

BACKGROUND ART

Conventional devices exist for ventilating roof spaces. A common construction of such devices involves positioning vents underneath a cover which is placed over the exposed roof ridge of a house. Ventilation occurs when warm air rises to the apex of the roof, and circulates under the cover and out through the vents.

Roof ridge covers and vents have, in the past, been constructed mainly from metal. Disadvantages of this material are its expense and the fact that it may require time-consuming forming operations to attain the desired shape.

It would be desirable to preform a roof ridge ventilator, ideally from an inexpensive material. U.S. Pat No. 4,545,292 to Inokawa, issued Oct. 8, 1985, describes ventilator sections formed by an extrusion process, but the sections are illustrated in the drawings as metal. Manufacturing the ventilator from plastic is another option which has been tried. For example, U.S. Pat. No. 4,676,147 to Mankowski issued Jun. 30, 1987, discloses a roof ridge ventilator having an extruded polypropylene cover member. A drawback to this design is that the vents through which the air circulates must be injection molded and then affixed to the cover members.

DISCLOSURE OF THE INVENTION

An object of my invention is to provide an improved plastic roof ridge ventilator.

In carrying out the above object and other objects of the invention, I have invented a novel roof ridge ventilator. The roof ridge ventilator of the present invention is formed entirely from extruded plastic, and comprises an elongated extruded plastic ridge cover including a pair of cap portions having inner and outer ends and also including a ridge connection that integrally connects the inner ends of the cap portions to each other, and a pair of elongated extruded plastic vents connected to the outer ends of the cap portions. A hinge is used as the ridge connection to permit angular adjustment of the ventilator. Thus, it may be used with roofs having different ridge angles.

The cover cap portions and their associated vents may be extruded in one integral piece, or a pair of vent members may be separately extruded and then attached to the ridge cover. In the preferred one-piece construction, each vent includes a flap portion connected to the outer end of the associated cap portion, a base portion connected to the outer end of the associated cap portion, and a connection for securing the flap portion to the base portion. Vent openings are provided in the base portion and in the connection to allow air to flow outwardly from below the ridge cover. To increase rigidity of the ventilator, stiffening rails are provided which project upwardly from the base portion of each vent and downwardly from the flap portion of each vent, respectively.

In an alternative preferred embodiment, the ridge cover and a pair of vent members are extruded as separate components. In this three-piece construction, the ridge cover is configured generally the same as in the first preferred embodiment, but the vent members are individually extruded and then affixed to the ridge cover. In this construction, each vent has a vent member which includes a base wall and side walls extending upwardly from the base wall in a spaced relationship to each other, and each vent also has a flap. Each flap is connected to the outer end of the associated cap portion, and connections are attached to the side walls of each vent member and each flap to secure the vent member to the associated flap. Thus, each flap sits atop its associated vent member to cooperate with each other in forming the vent.

Both the ridge cover and the vents are preferably extruded from polypropylene. Prior to extrusion, the polypropylene may be pigmented either black or white in order to minimize the fading effect of sunlight on the roof ridge ventilator.

These and other objects, features, and advantages of the present invention will be more apparent from the following description and drawings.

BEST MODE FOR CARRYING OUT THE INVENTION

Figure 1:
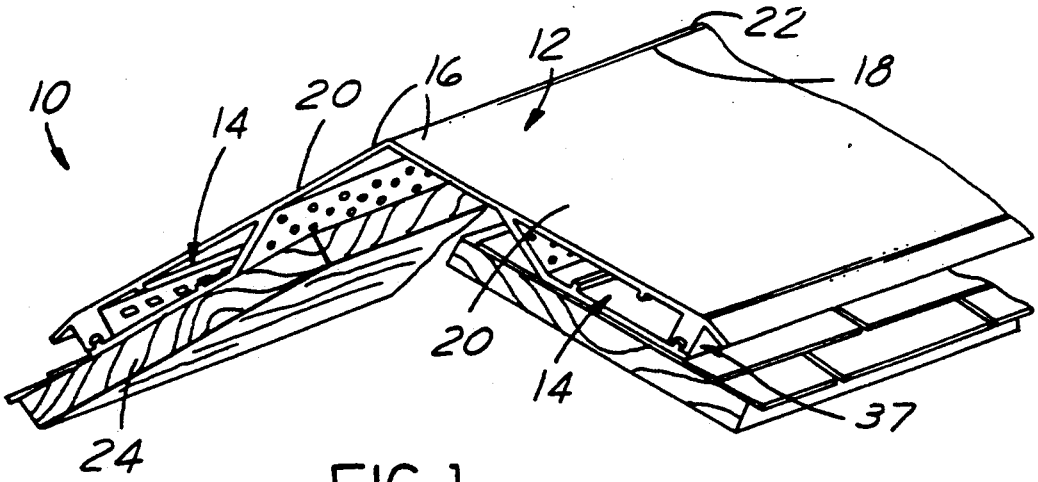
FIG. 1 is a partial perspective view of one embodiment of a plastic roof ridge ventilator according to my invention illustrated in a mounted position on a roof ridge.

Referring to FIG. 1, one preferred embodiment of a roof ridge ventilator constructed in accordance with this invention is generally designated by 10. The ventilator 10 comprises an elongated extruded plastic ridge cover 12 and a pair of elongated extruded plastic vents 14. The ridge cover 12 includes a pair of cap portions 16 each having an inner end 18 and an outer end 20. A ridge connection 22, for example a hinge, integrally connects the inner ends 18 of the cap portions 16 to each other. The ridge connection 22 is designed to permit angular adjustment of the cap portions 16 with respect to each other to permit the ventilator 10 to be used with roofs 24 having different ridge angles.

Figure 2:
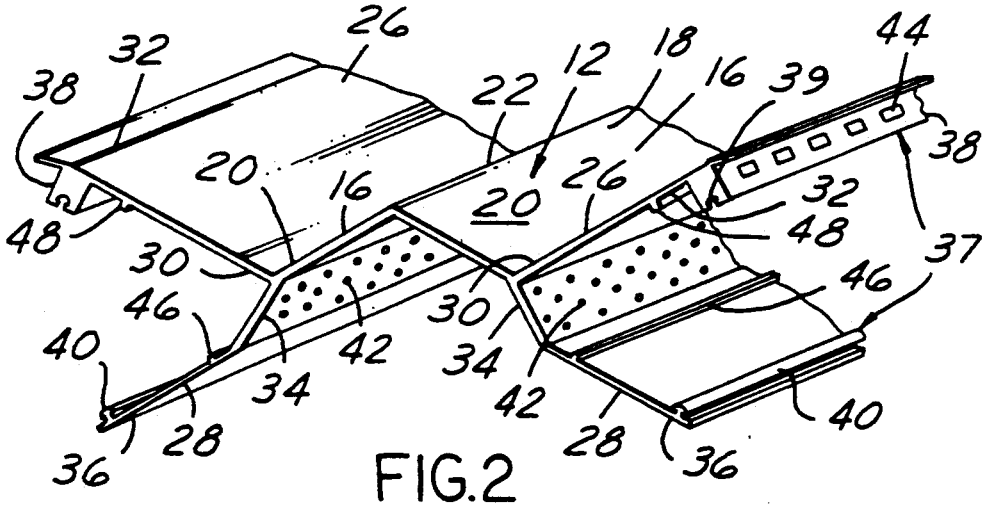
FIG. 2 is a partial perspective view of the plastic roof ridge ventilator shown in FIG. 1 prior to mounting on the roof ridge.

Referring now to FIG. 2, it can be seen that each vent 14 comprises a flap portion 26 and a base portion 28. Each flap portion 26 has a first end 30 connected to the outer end 20 of the associated cap portion 16, and a second distal end 32. Similarly, each base portion 28 has a first end 34 connected to the outer end 20 of the associated cap portion 16, and a second distal end 36.

The second end 32 of each flap portion 26 is securable to the associated second end 36 of each base portion 28 by a connection 37 consisting of a top connector 38 and a bottom connector 40. The connection is snap-like, and is formed when bottom connector 40 fits into a recess 39 in top connector 38. Inner vent openings 42 and outer vent openings 44 are provided through which air flows outwardly from below the ridge cover 12. The inner vent openings 42 are located in the vent base portion 28 adjacent its first end 34, and outer vent openings 44 are located in each top connector 38.

Elongated stiffening rails 46 and 48 project upwardly from each base portion 28 and downwardly from each flap portion 26, respectively. These rails 46 and 48 function primarily to give the ventilator 10 increased rigidity.

Figure 3:
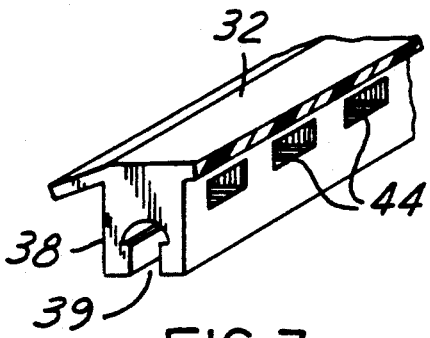
FIG. 3 is a partial perspective view of the outer vent openings of the ventilator.

FIG. 3 shows the outer vent openings 44 in greater detail. Outer vent openings 44 extend through top connector 38, and allow air to pass freely therethrough. Because they are oriented perpendicularly to the direction in which the ventilator 10 is extruded, the outer vent openings 44 must be punched out or cut out after the extrusion process, for example by a punch operation as the roof ridge ventilator 10 exits the extruder. The outer vent openings 44 are located near the top of top connector 38, so as not to intersect the bottom connector 40 when the roof ridge ventilator 10 is in the mounted position shown in FIG. 1.

Figure 4:
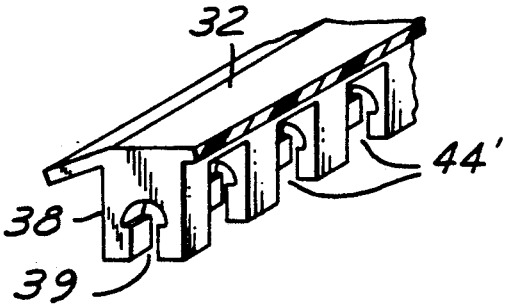
FIG. 4 is a partial perspective view of an alternative embodiment of the outer vent openings shown in FIG. 3.

FIG. 4 shows an alternative embodiment of the outer vent openings 44' in the top connector 38. As can be seen, the outer vent openings 44' can be cut out or punched out so that they leave an open side in the bottom of top connector 38. When top connector 38 is connected to bottom connector 40, the outer vent openings 44' resemble the preferred embodiment shown in FIG. 3, except that the outer vent openings 44' are relatively taller.

Figure 5:
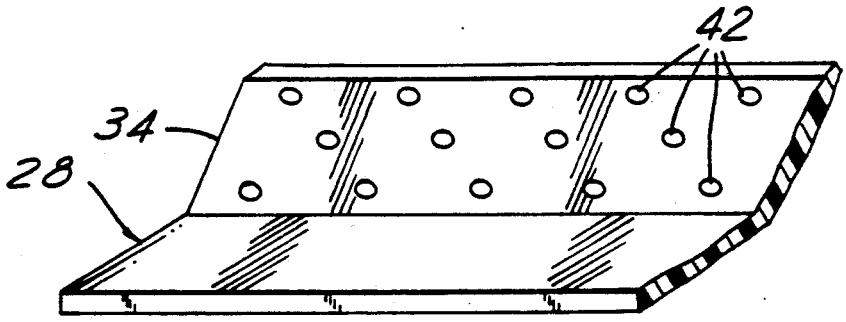
FIG. 5 is a partial perspective view of the inner vent openings of the ventilator.

FIG. 5 shows the inner vent openings 42 in greater detail. The inner vent openings 42 are located in the first end 34 of each base portion 28. These inner vent openings 42 preferably have a smaller cross section than the outer vent openings 44, in order to prevent passage therethrough of airborne particles, and may again be formed by a punch operation after the extrusion. When the roof ridge ventilator 10 is in place, warm air will rise to the apex of the roof and circulate out through inner vent openings 42, through vents 14, and finally out through outer vent openings 44.

Figure 6:
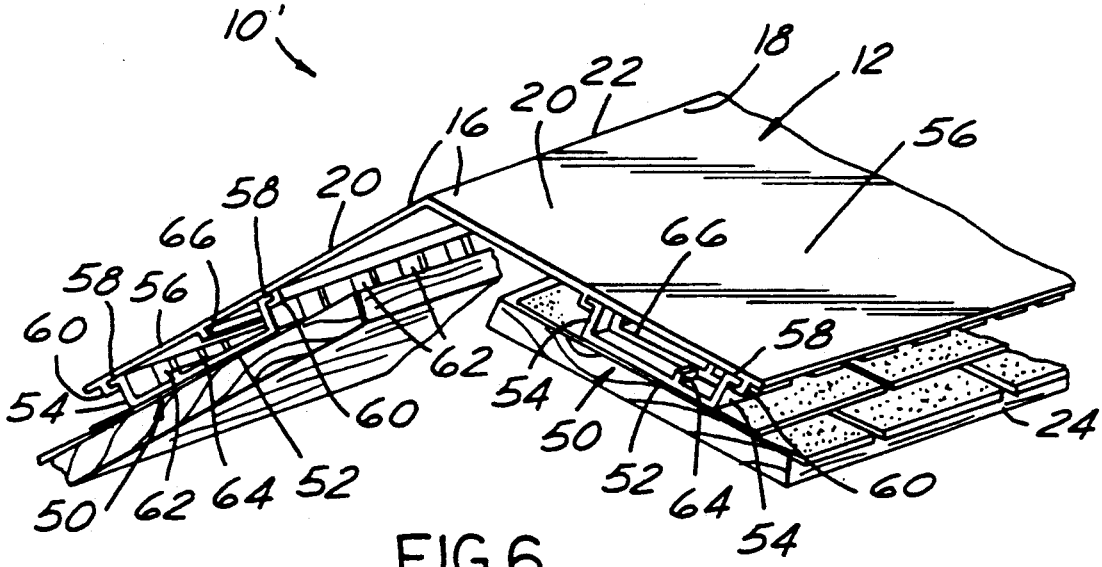
FIG. 6 is a partial perspective view of an alternative embodiment of the plastic roof ridge ventilator having a three-piece construction.

Referring now to FIG. 6, an alternative embodiment of the roof ridge ventilator is shown as 10'. In this embodiment, the ridge cover 12 and its associated vent members 50 form a three-piece construction, the vent members 50 being separable from the ridge cover 12. Thus, each vent has a vent member 50 which includes a base wall 52 and side walls 54 extending upwardly from the base wall 52 in a spaced relationship to each other. The top of each vent is formed by a flap 56 connected to the outer end 20 of the associated cap portion 16. The side walls 54 of each vent member 50 and each flap 56 have connections 58 and 60, respectively, that secure the side walls 54 to the associated flap 56.

In this embodiment, the vent openings 62 are located in the side walls 54 of each vent member 50. As with the first preferred embodiment, a stiffening rail 64 projects upwardly from the base wall 52 of each vent member 50, and a stiffening rail 66 projects downwardly from the flap 56 of each vent.

Figure 7:
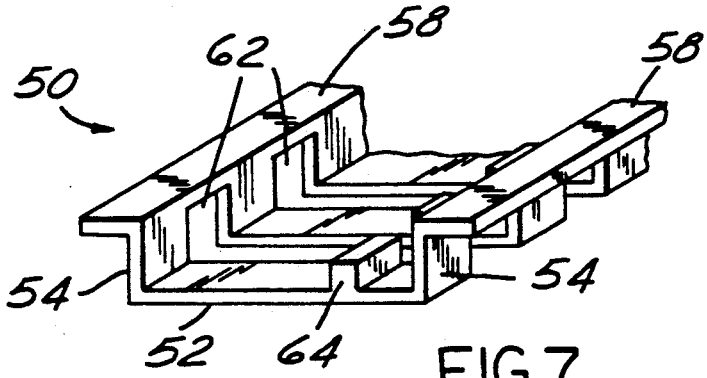
FIG. 7 is a partial perspective view of a detached vent member of the embodiment shown in FIG. 6.

In FIG. 7 there is shown in greater detail one of the vent members 50 of the three-piece embodiment of FIG. 6. Each side wall 54 extends upwardly from the base wall 52, and terminates in a connection 58 for securing the side walls 54 to the associated flaps 56. Vent openings 62 are cut or punched out of the vent member 50 such that they extend through the base wall 52 and the side walls 54.

Finally, it should be noted that the roof ridge ventilator is preferably extruded from polypropylene plastic. Because ultraviolet rays from sunlight tend to fade any pigmentation in the plastic, the ridge cover and vents are preferably extruded from plastic which has been pigmented either white or black. A roof ridge ventilator which has been pigmented white has the advantage of not showing pronounced color changes as it fades. A black color will not fade through off shades, as would, for example, green.

It should be understood that while the forms of the invention herein shown and described constitute preferred embodiments of the invention, they are not intended to illustrate all possible forms thereof. It also should be understood that the words used are words of description rather than limitation, and various changes may be made without departing from the spirit and scope of the invention disclosed.

I claim:

1. A plastic roof ridge ventilator comprising:

an elongated plastic ridge cover extruded as a unit including a pair of cap portions having inner and outer ends and also including a ridge connection that integrally connects the inner ends of the cap portions to each other; and a pair of elongated plastic vents having vent openings through which air flows outwardly from below the ridge cover, each vent including a flap portion having a first and integrally connected to the outer end of the associated cap portion and also having a second distal end, and each vent also including a base portion having a first end integrally connected to the outer end of the associated cap portion and also having a second distal end.

2. The roof ridge ventilator of claim 1 wherein the ridge connection comprises a hinge that permits angular adjustment of the cap portions with respect to each other to permit the ventilator to be used with roofs having different ridge angles.

3. The roof ridge ventilator of claim 1 wherein the vent openings are located in the first end of the vent base portion.

4. The roof ridge ventilator of claim 1 wherein each vent includes a connection for securing the second end of the flap portion thereof to the second end of its base portion.

5. The roof ridge ventilator of claim 4 wherein the connection of each vent includes additional openings.

6. The roof ridge ventilator of claim 1 wherein the base portion of each vent includes an upwardly projecting stiffening rail.

7. The roof ridge ventilator of claim 1 wherein the flap portion of each vent includes a downwardly projecting stiffening rail.

8. The roof ridge ventilator of claim 1 wherein the ridge cover and vents are extruded from polypropylene plastic.

9. The roof ridge ventilator of claim 1 wherein the ridge cover and vents are extruded from black pigmented plastic.

10. The roof ridge ventilator of claim 1 wherein the ridge cover and vents are extruded from white pigmented plastic.

11. A plastic roof ridge ventilator comprising:

an elongated plastic ridge cover extruded as a unit including a pair of cap portions having inner and outer ends and also including a hinge that integrally connects the inner ends of the cap portions to each other to permit angular adjustment of the cap portions with respect to each other to permit the ventilator to be used with roofs having different ridge angles; and a pair of elongated plastic vents connected to the outer ends of the cap portions, each vent including:

(a) a flap portion having a first end integrally connected to the outer end of the associated cap portion, a second distal end, and a downwardly projecting stiffening rail, (b) a base portion having a first end integrally connected to the outer end of the associated cap portion, a second distal end, an upwardly projecting stiffening rail, and vent openings located in the first end of the vent base portion through which air flows outwardly from below the ridge cover, and (c) a connection for securing the second end of the flap portion thereof to the second end of its base portion.

* * * * *